US005777631A

United States Patent [19]

Greene et al.

[11] Patent Number: 5,777,631

[45] Date of Patent: Jul. 7, 1998

[54] METHOD AND APPARATUS FOR DISPLAYING A VIDEO WINDOW IN A COMPUTER GRAPHICS DISPLAY

[75] Inventors: Spencer H. Greene, Palo Alto; Andrew D. Daniel, San Jose, both of Calif.

[73] Assignee: Alliance Semiconductor Corporation, San Jose, Calif.

[21] Appl. No.: 927,584

[22] Filed: Sep. 11, 1997

Related U.S. Application Data

[63] Continuation of Ser. No. 508,034, Jul. 27, 1995, abandoned.

[51] Int. Cl.[6] ..... G09G 5/36

[52] U.S. Cl. ..... 345/509; 345/439; 345/515; 345/153

[58] Field of Search ..... 345/115, 153, 345/501, 507, 509, 517, 503, 154, 515, 516, 439, 340, 118–120, 185, 189–191, 203

[56] References Cited

U.S. PATENT DOCUMENTS 5,506,604 4/1996 Nally et al. ..... 345/153
5,559,954 9/1996 Sakoda et al. ..... 345/153

*Primary Examiner*—Kee M. Tung
*Attorney, Agent, or Firm*—Abdy Raissinia

[57] ABSTRACT

A method and apparatus of displaying video and graphics data together in a computer graphics display using only the memory needed for the graphics display includes determining the location of the video window in the frame buffer, writing video data to the portion of the frame buffer bounded by the video window. During the raster scan of the frame buffer, if the raster position is within the video window, video data are read from the video data addresses within the video window. When the displayed video window position is changed, the video data are moved accordingly.

13 Claims, 5 Drawing Sheets

METHOD AND APPARATUS FOR DISPLAYING A VIDEO WINDOW IN A COMPUTER GRAPHICS DISPLAY

This application is a continuation of application Ser. No. 08/ 508.034, filed Jul. 27. 1995, now abandoned.

TECHNICAL FIELD

The present invention related generally to computer graphics displays having one or more motion video windows, are more particularly to methods for writing and reading motion video window data in a computer graphics system.

BACKGROUND OF THE INVENTION

Presently, computer systems commonly provide a display image composed of a number of graphics pixels. The pixels are stored and updated as graphics display data in a portion of the display memory designated as a frame buffer. To generate a display image, the series of data locations that make up the frame buffer are sequentially addressed, and the resulting data provided to an output device (such as digital-to-analog converter) which is used to drive the display monitor. This process is referred to as display refresh. The graphics controller in a typical system performs display refresh as well as image rendering (the updating of memory contents to display new images).

At the same time graphics controllers are providing higher resolutions and image rendering speeds, with the prevalence and ease of producing digitized video data and the rising number of applications incorporating such data, it is becoming increasingly desirable to display both graphics data and motion video data simultaneously on the same display.

U.S. Pat. No. 5,406,306 issued to Siann et al. on Feb. 5, 1993 sets forth a system wherein a single display memory is apportioned into a graphics portion and a video portion. The graphic portion includes a video window area defined by each pixel being a particular data code (in some applications the data code corresponds to a particular color, often referred to as colorkey). Pixel data and video data are read from the two portions of the display memory. If the pixel data matches the data code, a digital multiplexer provides video data to an output latch. Otherwise, the multiplexer provides graphics data to the output latch.

Computer graphics display systems employing a colorkey type method for producing video windows, thus have a certain minimum display memory size requirement. There must be sufficient memory to store the graphics data (also called the frame buffer) and additional memory (also called off-screen memory) to store one frame of video data. Accordingly, as the resolution of frame buffer increases, the allowable resolution of the video window decreases for a fixed memory size, and vice versa. These limitations are made even more critical due to the prevalence of common physical memory sizes, such as 1 megabyte (MB) and 2 MB. As just one example, for the common configuration employing 1 MB of display memory, and having an 800×600×16 bits per pixel display resolution, the amount of off-screen memory available is 86.5 kilobytes (KB). This leaves an insufficient amount of available display memory for many common video window formats, which typically require between 120 KB and 330 KB to store motion video windows of 320×240 at sixteen bits per pixel (bpp), for example.

In order to provide a larger number of display options for a limited physical memory size, it would be desirable to provide a method of storing and displaying video data and graphics data together on a display that requires less off-screen memory than prior art approaches.

SUMMARY OF THE INVENTION

It is an object of the present invention to provide a method of storing video data for display in a video window that reduces the amount of total memory space required for the video and graphics data.

According to the present invention, a method of displaying a video window in a computer graphics display includes determining the location of the displayed video window in the frame buffer and optionally writing video data "in-place" to the portion of the frame buffer obscured by the video window. When offscreen memory is available, video data are stored in a contiguous offscreen video buffer. In particular modes or configurations where not enough offscreen memory is available, the video data are stored in place of graphics data which would be "behind" the visible video window, and therefore, are not displayed. During the raster scan of the frame buffer, if the raster position is within the video window, video data are read from the video data addresses, otherwise graphics data are read from the graphics frame buffer addresses.

According to one aspect of the present invention the video data are logically divided into a number of video lines, and the number of display memory bytes between subsequent video lines is equivalent to the number of memory bytes between subsequent frame buffer lines.

According to the present invention, a system for displaying a video window in a graphics display includes a raster address generator, a pixel position counter, a video window detect circuit, a video data address generator, an address multiplexer, a frame buffer, and a scaling unit. The frame buffer includes graphics pixel data which make up the graphics portion of the display. In addition, the video data for the video window are stored in the area of the frame buffer that translates into the portion of the graphics display that is occluded by the video window or in a contiguous offscreen buffer. During a raster-scan operation the graphics pixel counter generates a series of graphics pixel positions which make up a graphics portion of the display. The graphics pixel positions are received by a window detect circuit which controls the MUX. If the pixel positions are outside the video window, addresses corresponding to the graphics pixels are received by the MUX and output to the frame buffer. If the graphics pixel positions are within the video window, the window detect circuit allows addresses generated by the video data address generator to be output from the MUX to the frame buffer, instead of the graphics pixel addresses. For subsequent display lines that include the video window, the video data address generator either repeats the same line of video data, or increments the address position to the following line of video data, according to a signal from the scaling unit.

According to another aspect of the present invention, a video window position counter modifies addresses of the video window data according to a change in displayed video window position within the graphics display.

An advantage of the present invention is that, provided the unscaled video data can fit within the limits of the display memory bounded by the video window, no offscreen memory is required for the video window.

Yet another advantage of the present invention is that video data may be stored in a different color format than graphics data, reducing the computational burden to convert all data to a common format before storing to display memory.

Yet another advantage of the present invention is that video data may be stored in a different format then graphics data, permitting the use of formats that provide more precise colors to the video window than could be than could be afforded to the graphics potion of the screen with a given memory architecture.

Other objects and advantages of the invention will become apparent in light of the following description thereof.

DETAILED DESCRIPTION OF THE EMBODIMENTS

Figure 1A:
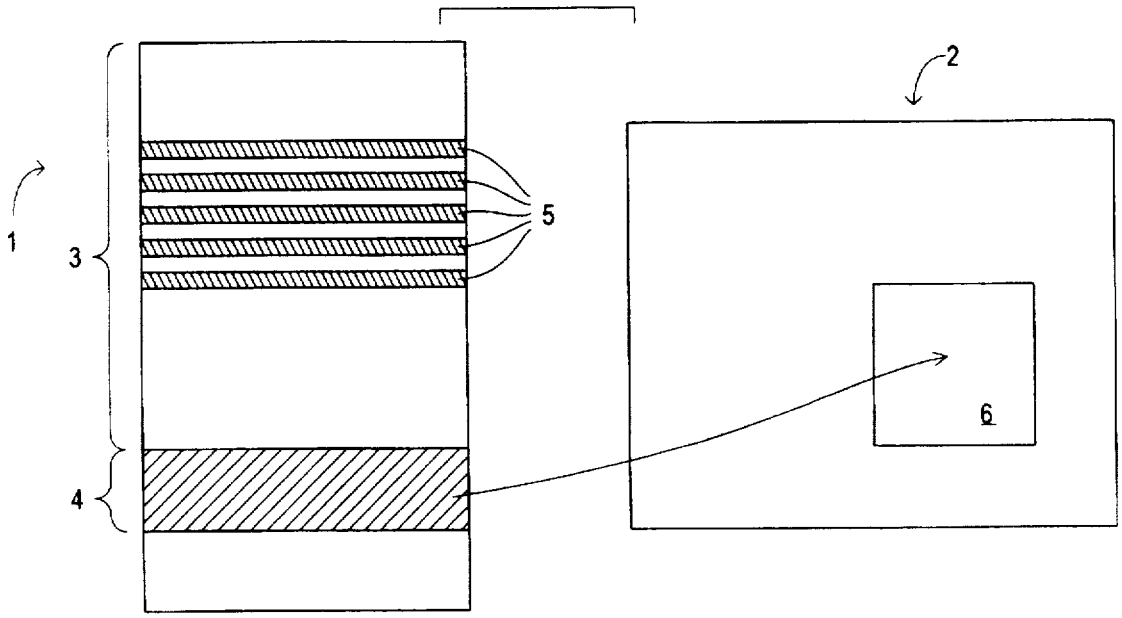
Fig. 1a (PRIOR ART)
FIG. 1*a* is an illustration of a prior art display memory arrangement.

FIG. 1*a* illustrates a video window display method of the prior art. A display memory 1 and corresponding display image 2 are depicted in figure. The display memory 1, includes a frame buffer 3 and a video data portion 4. The frame buffer 3 further includes sections of colorkey data 5 which map to define a video window 6 within display image 2. When colorkey data 5 are detected, video data 4 are provided to a display output device resulting in a video image being displayed in the video window 6.

Figure 1B:
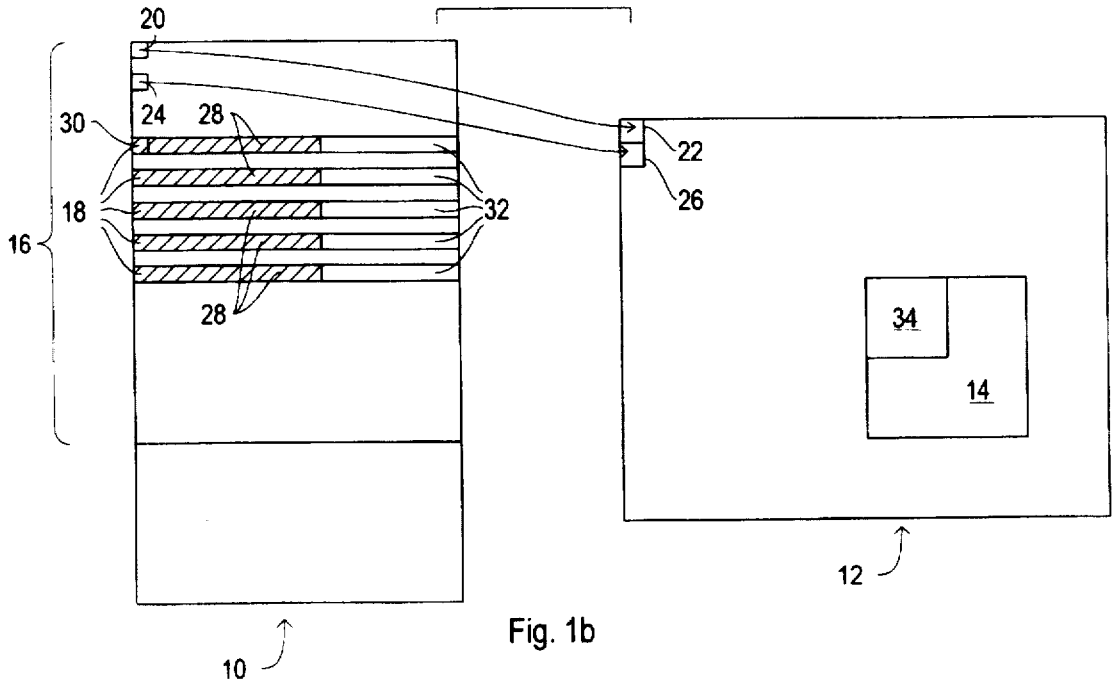
FIG. 1*b* is an illustration of a display memory arrangement according to a preferred embodiment of the present invention.

FIG. 1*b* illustrates the video window display method of the present invention. As in the prior art example, a display memory 10 is used to store a display image 12 with a video window 14, and includes, in said display memory 10, a frame buffer 16. Unlike the prior art, video data 18 are optionally integrated into the frame buffer 16, eliminating the need for a separate, video data portion.

In a preferred embodiment of the present invention, the beginning of each line of the graphics display is offset in memory by a graphics line stride value. Referring once again to FIG. 1*b*, the first pixel data location is shown mapping a the first graphics pixel 22 of the first display line in the display image 12. A second pixel data location 24 maps to the first graphics pixel 26 of the second display line. The difference in display memory addresses between the first pixel data location 20 and the second pixel data location 24 represents the graphics line "stride" value. This value will always be at least as large as, and typically exactly equal to, the amount of display memory taken for one display line of graphics data, i.e. 1600 bytes for a display screen 800 pixels wide at 16 (two bytes) per pixel. In the preferred embodiment, the video is data 18 are logically divided into individual video data lines 28 that are spaced within the frame buffer 16 by the graphics line stride value. It is noted that the graphics line stride value is not related to the width of the video window 14. Accordingly, the video data lines 28 can be conceptualized as each being stored on a separate display line. As set forth in FIG. 1*b*, a first video pixel 30 of the first video data line 28 is written to the first addressable location within the frame buffer 16 that would, in a prior art approach, map to the first graphics pixel within the displayed video window (a pixel having a colorkey value in the example of FIG. 1*a*). (This case assumes a non-occluded video window 14).

It is noted that in the preferred embodiment of the present invention, the video data may also be written to an offscreen location. In such a case the video data would be written to the offscreen location with the beginning of each line being offset by the video data line length.

It is understood that the displayed video window 14 of FIG. 1*b* is generated by scaling the video data 18 up to fit the displayed video window 14 size. In addition, the ratio of video pixel depth (i.e., bits per pixel) to graphics pixel depth must be less than or equal to the horizontal upscale factor. The amount of memory space "behind" the displayed video window 14 is greater or equal to the actual amount of video data memory 18 required to store the video window 14. As a result there may be unused portions 32 within the frame buffer 16 To help illustrate this point an unscaled video window 34 is shown by dashed lines within the video window 14.

Figure 2A:
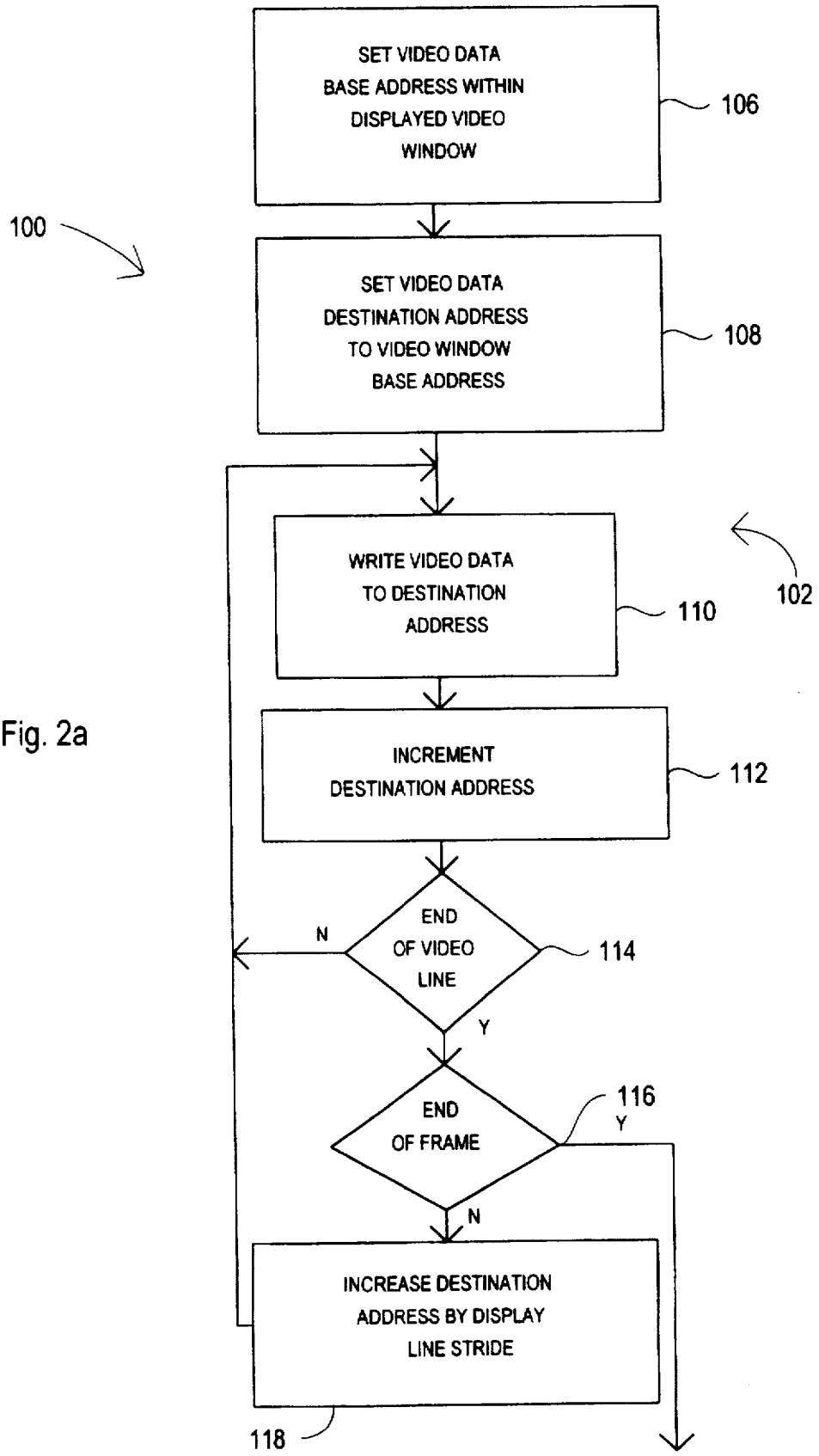
FIGS. 2*a* and 2*b* is a flow chart illustrating a method of displaying a video window within a graphics display according to one embodiment of the present invention.
Figure 2B:
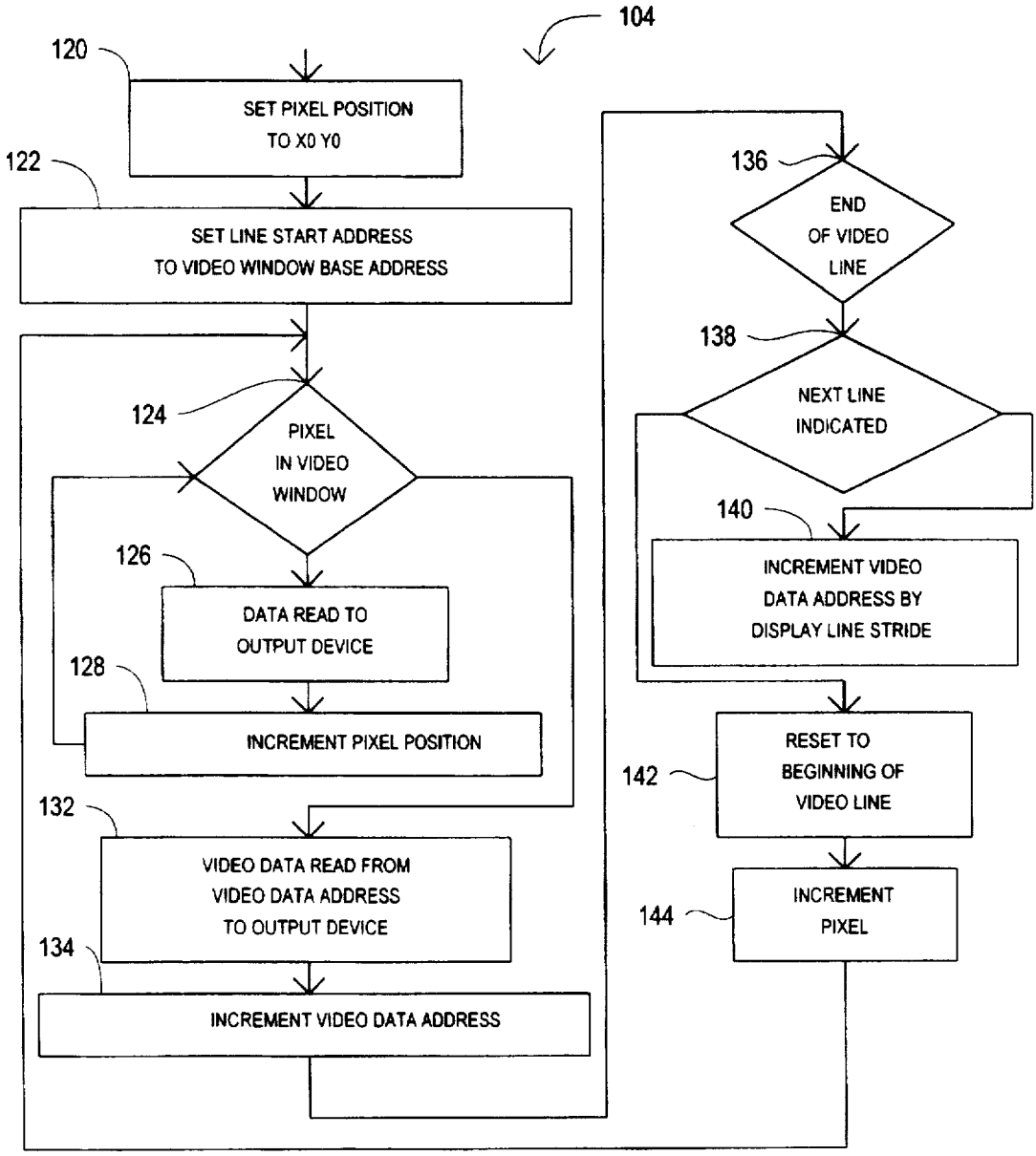

Referring now to FIGS. 2*a* and 2*b*, a flowchart is set forth illustrating the method of displaying a video window according to one embodiment of the present invention. The method is represented by the general reference character 100 and is shown to include a video data write portion 102 (FIG. 2*a*) and a display memory raster-scan portion 104 (FIG. 2*b*).

The video data write portion 102 includes setting the video window data base address to an address within the displayed video window (step 106). In a typical non-occluded case, as mentioned above, this is the display memory address that would map to the upper left corner graphics pixel of the video window. (The location of the first colorkey pixel in the prior art example of FIG. 1*a*.) The video data raster address is then set to the video data base address (step 108). The first video data are then written to the frame buffer location specified by the video data base address. In the preferred embodiment, a thirty-two bit system bus is assumed. In addition it is further assumed that the video window location is 32-bit aligned. Hence, the video data write is started by writing the first four bytes of video data to the destination address (which is initially the video data base address) (step 110). It is understood that the source of the video data is either the CPU of the system (decoding stored video data) or a hardware device such as a television decoder. The CPU algorithm or hardware device write data to the video data area one video line at a time, by methods which are well known to those practiced in the art.

The video data destination address is then incremented (step 112) to a next video data address. This process repeats until an entire line of video data is written to the frame buffer 16 and the end of a video line is reached (step 114). At the end of a video line a check is made to determine if additional lines remain to be written in the current video frame. (step 116). If an end of frame is not detected, the video data destination address is incremented (step 118). In the preferred embodiment the address is incremented by the display line stride previously described in conjunction with FIG. 1*b*. Accordingly, video data is written in this manner until the end of the video frame is reached.

In the preferred embodiment of the memory raster-scan portion 104, to begin a display frame the display raster position is set to XO, YO (step 120). This position corresponds to the first graphics pixel 22 of the first display line as shown in FIG. 1*b*. Next, referring back to FIG. 2*b* the video line start address is set to the video data base address (step 122), and the video data raster address is set to the video data line start address.

The display raster position is checked to see if it lies within the displayed video window (step 124). If the position is not in the displayed video window, the address corresponding to the X-Y position (or multiple, consecutive X-Y positions) is translated into the display memory physical address which results in one or more graphics pixels being read to an output device (step 126). The display raster position is then incremented (step 128).

If the display raster position is within the displayed video window, the data at the video data raster address, representative of one or more video pixels, is read to an output device (step 132). The video data raster address is then incremented to the next address (step 134).

As mentioned above, the video data is unscaled when stored, and may be upscaled to produce a larger displayed video window. Upscaling is determined according to a provided X scale factor and Y scale factor. For example, if the X scale factor and Y scale factor were both equal to two, the displayed video window would be twice as large as the stored video window. Thus, in the case where the Y scale factor is greater than one, multiple reads of the same video data line would be required. It is noted that scale factors may be non-integral.

Referring back to FIG. 2*b*, consecutive video data are read to the output device until an end of video line is reached (step 136). Once the end of a video line is reached, the Y scaling parameters of the video window are checked to see if a new video data line is indicated (step 138). If the same line of video is to be repeated in the next display line, the line video start address remains unchanged. If a new line of video data is indicated, the video line start address is incremented by the display line stride (step 140), then the video data raster address is set to the updated video line start address to be prepared for the next video line. The process returns to step 124 once the display raster position is incremented (step 144).

Figure 3:
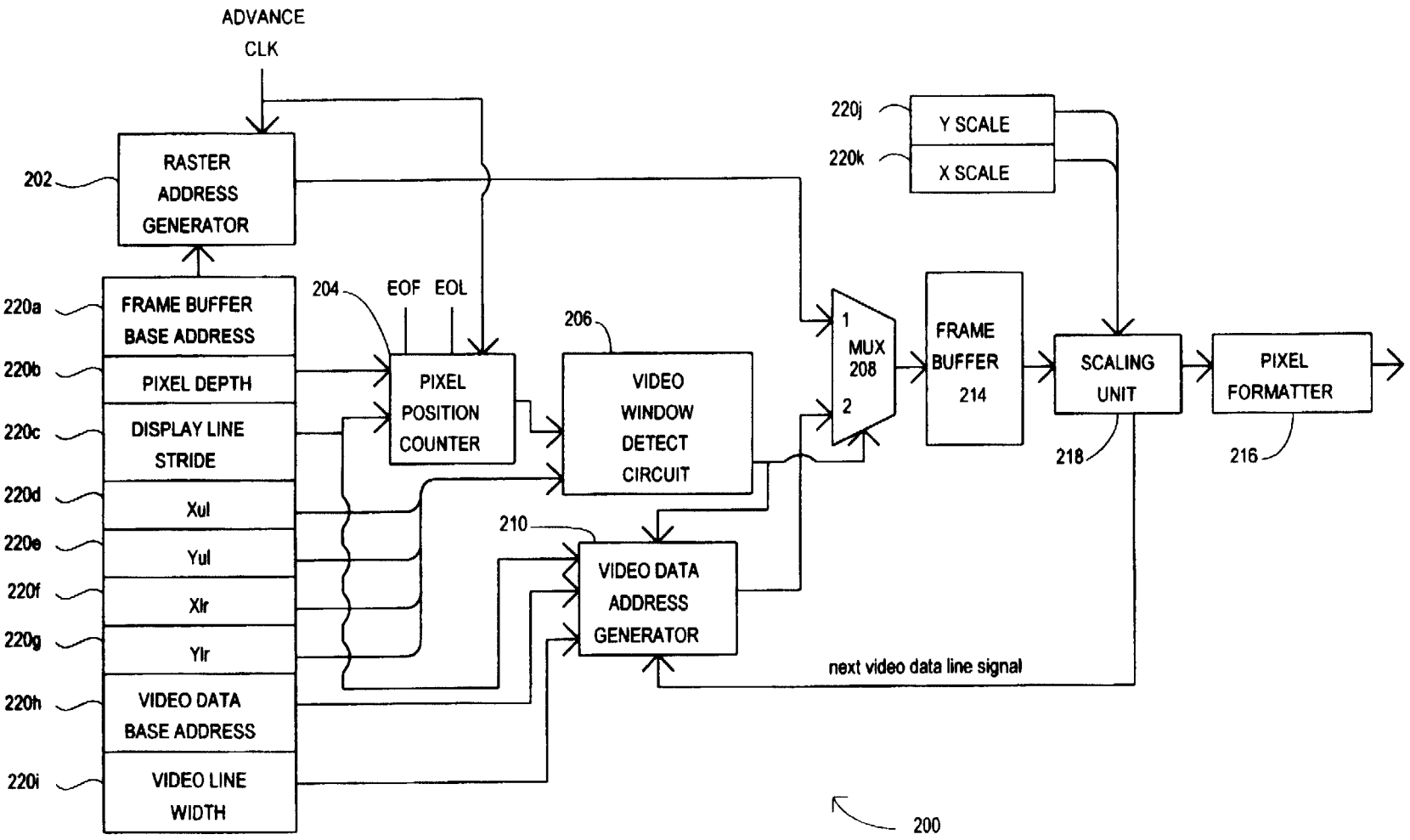
FIG. 3 is a block diagram illustrating a system for displaying a video window within a graphics display according to one embodiment of the present invention.

A system for implementing the above described method is illustrated in FIG. 3. The video window display system 200 is shown to include, generally, a raster address generator 202, a pixel position counter 204, a video window detect circuit 206, an address multiplexer (MUX) 208, a video data raster address generator 210, a frame buffer 214, a pixel formatter 216, and a "back-end" scaling circuit 218. In addition, the system includes a number of data registers 220 as will be described in more detail herein.

The display raster address generator 202 receives a clock signal and generates a series of raster addresses starting with a frame buffer base address loaded from register 220*a*. The raster addresses are provided as a first input to the MUX 208.

The pixel position counter 204 receives a clock signal, an end-of-line signal (EOL), an end-of-frame signal (EOF), and a graphics pixel depth value from register 220*b*. From these values, the pixel position counter generates a series of X-Y pixel positions. Assuming the system 200 includes a thirty-two bit data bus, and the pixel depth is sixteen bits per pixel, for the first raster address generated in the frame, the pixel position counter 204 would generate the two consecutive pixel positions (XO,YO and Xl,YO).

The X-Y position values are provided as an input to the video window detect circuit 206 which compares the position values with the limits of the video window. In the preferred embodiment the limits of the video window are stored as an upper left window corner position (Xul, Yul) and a lower right corner window position (Xlr, Ylr) in registers 220*d*–220*g*. When an X-Y position is within the video window detect circuit 206 an indicator signal is provided to the MUX 208 and the video data address generator 210. Window detect circuits are well known in the art and so will not be discussed in further detail herein.

The video address generator 210 generates a series of video data addresses, beginning from the video data base address stored in register 220*h*. The video data addresses are received at a second input to the MUX 208. If the indicator signal from the video window detect circuit 206 is received by the MUX 208, the video data addresses are output from the MUX 208 instead of the graphics raster addresses.

The frame buffer addresses (video data addresses or raster addresses) are received by the frame buffer 214 which provides a data output consisting of a series of graphics data and video data.

Video pixels are scaled by the back-end scaling unit according to an X scale value stored in register 220*j* and a Y scale value stored in register 220*k*. The back-end scaling unit 218 provides a next video data line signal to the video data address generator 210. The next video data line signal indicates to the video data generator 210 that addresses for the next line of video data should be generated. Absent this signal, the video data address generator 210 will repeat the previous line of video data. For example, in a simplest case, for a Y scaling value of two, the scaling unit 220 would provide a new video data line signal every other display line. The scaling unit 218 implements a general fractional scaling factor by any of several algorithms well known in the art, such as a digital differential analyzer (DDA) for example. Both types of data are formatted accordingly into graphics pixels or video pixels by the pixel formatter 216.

Figure 4:
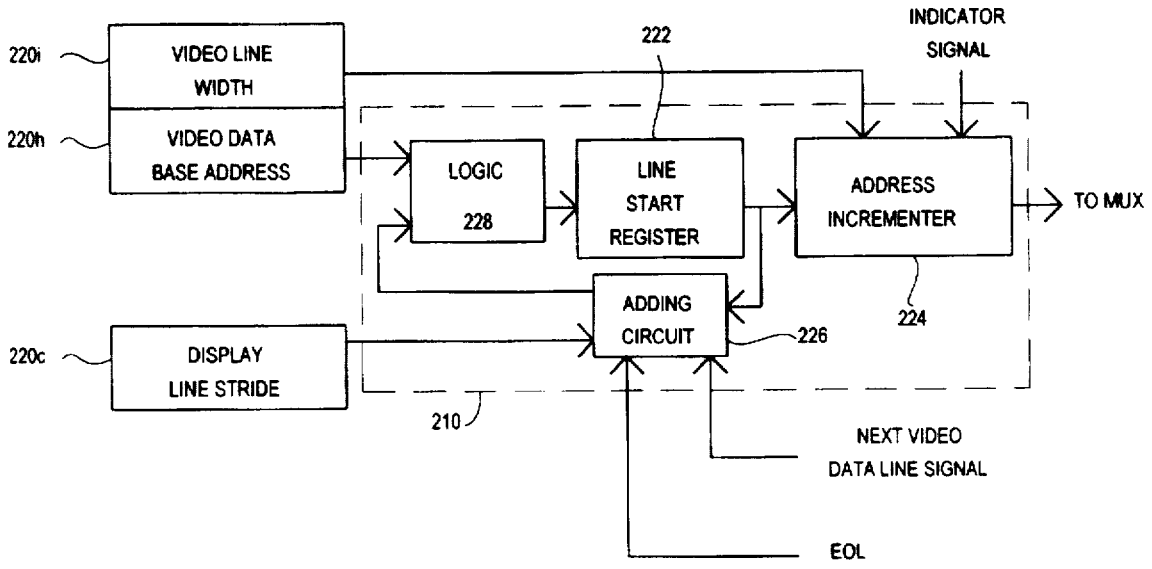
FIG. 4 is a block diagram illustrating the video data address generator and associated registers according to the preferred embodiment.

FIG. 4 sets forth a block diagram of the video data address generator 210 and registers 220*h*–220*i*. The video data address register is shown to include a line start register 222, an address incrementer 224, an adder circuit 226, and gating logic 228. When a new display frame is indicated the base address from register 220*h* is loaded into the line start register 222 via the gating logic 228. At the start of each display line, the contents of the line start register 222 are loaded into the address incrementer 224. When the indicator signal is received from the window detect circuit 206 the address incrementer 224 increments its contents. This address is provided as an input to the MUX 208. Using the video line width value from register 220*i*, the address incrementer 224 increments the address until the addresses for a full line of video data have been output to the MUX 208.

The adder circuit 226 is responsive to the next video data line signal from the scaling unit 218 and an end-of-line signal (EOL). If both signals are present, the adder circuit 226, in conjunction with the gating logic 228, increments the line start address within register 222 by the display line stride value of register 220*c*.

The system according to the present invention may be implemented as part of a graphics accelerator integrated circuit. The system is intended to be used in conjunction with software loaded into the host which can detect a change in the video window position, and move the video data to the addresses corresponding to the new video window position.

Figure 5:
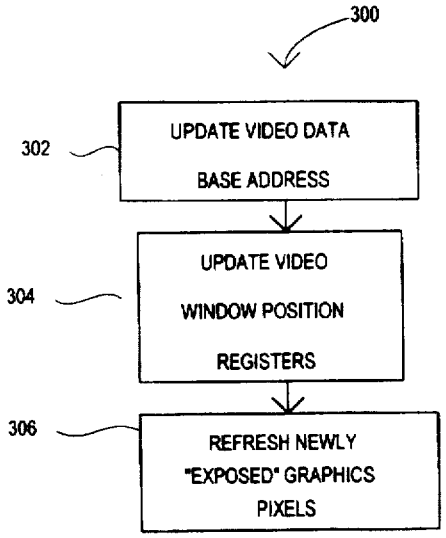
FIG. 5 is a flowchart illustrating a method of moving the video window according to the preferred embodiment.

Referring now to FIG. 5 the method of moving the video window is designated by the general reference character 300, and includes updating the video data base address (step 302). Likewise, the displayed video window position registers are also updated to store new X-Y positions corresponding to the new displayed video window position (step 304). Lastly, the pixel positions behind the old video window position (now exposed) are refreshed (step 306). This is accomplished by having the window operating system redraw the desktop.

While the preferred embodiment sets forth a system and method for displaying video data, it is understood the present invention could be utilized to display an upscaled window of graphics data in the same format as the desktop display or a different format. It is understood that the invention has been described in connection with its preferred embodiments, and may be changed, and other embodiments derived, without departing from the spirit and scope of the invention. Accordingly, the above disclosure is not intended to be limiting and the appended claims are to be interpreted as encompassing the entire scope of the invention.

What is claim is:

1. In a raster-scan computer graphics display system having a display memory that includes a frame buffer, a method of storing video data in said frame buffer, where the video data corresponds to at least one rectangular video window on a display, and displaying said video data on a graphics display so as to obscure a portion of the graphics display with the video data, comprising the steps of:

(a) writing graphics data to the frame buffer;

(b) establishing boundary limits of said at least one rectangular video window;

(c) writing video data to a video data memory situated within said frame buffer in the place of obscured graphics data;

(d) generating refresh addresses corresponding to pixel locations on said display; and (e) providing the graphics data as an output when the refresh address corresponds to a pixel situated outside of said at least one rectangular video window, and providing the video data as an output when said refresh address corresponds to a pixel situated within said at least one rectangular video window.

2. The method of claim 1 wherein:

said video data are logically divided into a series of video lines, step (a) includes writing a graphics line width value to a graphics line pitch register; and step (c) includes incrementing a video destination address by the graphics line width value at the start of each video line subsequent to a first video line, such that each video line is written to an address that corresponds to a different display line within the video window.

3. The method of claim 1 wherein:

step (b) includes storing an upper left corner position value in a window first position register and storing a lower right corner position value in a second position register.

4. The method of claim 3 wherein:

step (c) includes writing the video data at an initial base address, the initial base address corresponding to the upper left corner position value.

5. The method of claim 4 wherein:

step (c) further includes storing an upper left X (Xul) and Y (Yul) position values, and a lower right X (Xlr) and Y (Ylr) position values;

step (d) includes generating X-Y pixel position values corresponding to the refresh addresses; and step (e) includes comparing the X-Y pixel position to th e Xul, Yul, Xlr, and Ylr values.

6. The method of claim 1 wherein:

step (e) includes generating a series of video data addresses when the refresh address corresponds to a pixel within said at least one rectangular video window.

7. The method of claim 6 wherein step (e) includes multiplexing between the refresh addresses and the video data addresses.

8. The method of claim 1 wherein:

step (b) includes storing a video base address value for the video data in a video base address register, in response to moving a video window from a first video window position to a second video window position, calculating an address offset between the first video window position and the second video window position, changing the video base address by the address offset to generate a second video base address, and changing the boundary limits by the address offset; and step (c) includes writing the video data for a following video frame to the frame buffer according to the second video base address.

9. The method of claim 1 further including:

(f) in response to a change in the position of the displayed video from a first position to a second position, copying the video data to a second frame buffer position corresponding to the second position of the displayed video window, and changing the boundary limits according to the second position of the displayed video window.

10. In a raster-scan computer graphics display system having a display memory that includes a frame buffer, a system for writing and displaying video data and graphics data in a single frame buffer, comprising:

a refresh address generator for generating a series of refresh addresses;

video window registers for storing position limits of at least one video window;

a window detect circuit for providing an indicator signal when the refresh addresses are within the limits of a video window;

a video data base address register for storing a base address of the video data, the base address being located within the limits of the video window;

a video data width register for storing a video data line width value;

a video data line offset register for storing a video line offset value;

a video data address counter responsive to the first indicator signal for generating a series of video data addresses equal to one video data line according to the video data line width value, for each frame, said video data address counter initially starting at the base address and incrementing the base address by video line offset values to generate start addresses of subsequent video data lines; and an address multiplexer for receiving the refresh addresses and the video data addresses as inputs, said address multiplexer providing the video data addresses as an output in response to the first indicator signal, and the refresh addresses when no first indicator signal is present.

11. The system of claim 10 wherein:

the video data line offset register stores a video line offset value that is equal to an offset between display lines in the frame buffer.

12. The system of claim 10 further including:

an X-Y position counter for generating a series of X-Y positions, the X-Y positions corresponding to the refresh addresses;

a plurality of video window limit registers for storing the limits of the video window as X-Y values; and said window detect circuit compares the X-Y positions with the values in the window limit registers.

13. The system of claim 10 further including:

a Y scaling circuit for generating a next video line signal according to Y scaling value;

the video line offset value in said video data line offset register is equal to an offset between display lines in the frame buffer; and said video data address counter increments the start address of subsequent video data lines by the video line offset value according to the next video line signal.

* * * * *